US005964574A

United States Patent [19]

Meier et al.

[11] Patent Number: 5,964,574

[45] Date of Patent: Oct. 12, 1999

[54] EXHAUST-GAS TURBINE OF A TURBOCHARGER

[75] Inventors: Marcel Meier, Ennetturgi; Martin Seiler, Wettingen, both of Switzerland; Claus Weisheit, Bonndorf/Schw., Germany; Marcel Zehnder, Niederwil, Switzerland

[73] Assignee: Asea Brown Boveri AG, Baden, Switzerland

[21] Appl. No.: 09/012,035

[22] Filed: Jan. 22, 1998

[30] Foreign Application Priority Data

Jan. 29, 1997 [DE] Germany ..... 197 03 033

[51] Int. Cl.[6] ..... F01D 9/04

[52] U.S. Cl. ..... 415/110; 415/208.2

[58] Field of Search ..... 415/110, 111, 415/113, 183, 185, 186, 191, 202, 208.1, 208.2, 208.3, 209.2, 209.3, 170.1, 211.1, 224.5

[56] References Cited

U.S. PATENT DOCUMENTS

| | | | |
|---|---|---|---|
| 1,154,777 | 9/1915 | Kieser | 415/202 X |
| 1,922,017 | 8/1933 | Guy | 415/185 |
| 2,447,942 | 8/1948 | Imbert et al. | 415/191 X |
| 3,068,638 | 12/1962 | Birmann . | |
| 3,737,247 | 6/1973 | Horning | 415/195 |
| 4,242,040 | 12/1980 | Swearingen | 415/113 |
| 4,679,984 | 7/1987 | Swihart et al. . | |
| 5,059,091 | 10/1991 | Hatfield | 415/11 |
| 5,249,920 | 10/1993 | Sheperd et al. | 415/134 |

FOREIGN PATENT DOCUMENTS

| | | | |
|---|---|---|---|
| 0024275 | 3/1981 | European Pat. Off. . | |
| 994013 | 12/1944 | France | 415/191 |
| 111098 | 10/1928 | Germany | 415/216 |
| 1040569 | 10/1958 | Germany | 415/209.2 |
| 3541508C1 | 2/1987 | Germany . | |
| 52-57410 | 5/1977 | Japan | 415/110 |

OTHER PUBLICATIONS

"Kolbenring–Handbuch"; pp. 174–175; undated.
"Fey Lamellenringe"; pp. 4–5; undated.

*Primary Examiner*—John E. Ryznic
*Attorney, Agent, or Firm*—Burns, Doane, Swecker & Mathis, L.L.P.

[57] ABSTRACT

The object of the invention is to provide a nozzle ring for the exhaust-gas turbine of a turbocharger which, in addition to an improved service life, also guarantees a constant efficiency.

According to the invention, this is achieved in that an radial expansion gap (20) is formed between the turbine casing (2) and the nozzle ring (11), and at least one seal (22) is arranged in the expansion gap (20). To this end, an encircling groove (21) accommodating the seal (22) is formed in at least one of the fastening elements (16, 17) of the nozzle ring (11) or in at least one of the components (3, 4, 5) which surround the fastening elements (16, 17).

9 Claims, 3 Drawing Sheets

EXHAUST-GAS TURBINE OF A TURBOCHARGER

BACKGROUND OF THE INVENTION

Field of the Invention

The invention relates to the exhaust-gas turbine of turbocharger having a nozzle ring arranged in the inflow passage of the exhaust-gas turbine and directing the working medium onto the turbine blades.

Discussion of Background

The nozzle rings of the exhaust-gas turbines of turbochargers are highly stressed by fluctuating operating conditions, i.e. increases or reductions in the pressure and temperature of the working medium. Depending on the turbine used and in accordance with the actual conditions of use, the working medium may have a large temperature gradient. Since a nozzle ring always has only a small mass compared with the turbine components surrounding it, it is subjected to relatively pronounced thermal expansions.

The fastening of the nozzle ring is often effected by simple clamping in the casing of the exhaust-gas turbine. Since the nozzle ring in this case cannot expand in an appropriate manner, material deformations and cracks occur, so that such a nozzle ring has an inadequate service life. Accordingly, it must be exchanged at relatively short time intervals, which, apart from additional costs, also results in withdrawal of the turbine from operation.

For this reason, a sufficiently large expansion gap must be formed between the nozzle ring and the components surrounding it. In such a solution, however, the disadvantage of a not inconsiderable bypass flow of the working medium through the expansion gap occurs. This can result in a distinct reduction in the efficiency of the turbine.

In order to remove these disadvantages, a nozzle ring has been developed according to EP 00 24 275-A1 which can freely expand in both the axial and radial direction and nonetheless has a closable expansion gap. To this end, the locking of this nozzle ring is mainly effected by means of an elastic element which constantly presses the nozzle ring against its seat in the turbine casing on account of prestressing. In this case, sealing of the expansion gap is effected at the same time.

However, it has been found that the prestressing of the elastic element diminishes on account of the high temperatures of the working medium and the nozzle ring. The decreasing prestressing of the elastic element eventually leads to a situation in which the nozzle ring no longer bears against its seat and the expansion gap in turn lets through a bypass flow. Accordingly, lasting sealing of the expansion gap relative to a bypass flow cannot be ensured in this solution either, and thus an ever decreasing efficiency cannot be prevented.

SUMMARY OF THE INVENTION

Accordingly, one object of the invention, in attempting to avoid all these disadvantages, is to provide a novel nozzle ring for the exhaust-gas turbine of a turbocharger which, in addition to an improved service life, also guarantees a constant efficiency.

According to the invention, this is achieved in that, in a device according to the preamble of claim 1, an radial expansion gap is formed between the turbine casing and the nozzle ring, and at least one seal is arranged in the expansion gap. In this case, the nozzle ring consists of two fastening elements which are arranged in the recess and are connected to one another via a number of guide blades. An encircling groove accommodating the seal is formed either in at least one of the fastening elements or in at least one of the components of the turbine casing which surround the fastening elements.

During the operation of the turbocharger, the radial expansion gap formed between the nozzle ring and the turbine casing permits a free expansion of the nozzle ring in both the axial and radial direction. At the same time, the seal, on account of the exhaust-gas pressure of the internal combustion engine connected to the turbocharger, is pressed against the groove, as a result of which the expansion gap is largely sealed. In this way, sufficient clearance for the thermal expansion of the nozzle ring on the one hand and suitable sealing of the bypass flow on the other hand are guaranteed.

It is especially expedient if the encircling groove is oriented in the direction of flow of the exhaust gases. An especially large sealing surface can thereby be realized, which results in improved sealing and thus in a higher turbine efficiency.

In accordance with the actual space conditions in the region of the nozzle ring, the seal may be arranged in each case between the nozzle ring and the gas-inlet casing, the turbine-side casing component or the gas-outlet casing.

The seal is designed as a lamellar ring. Especially advantageous is a double lamellar ring made of a sufficiently heat-resisting material, such as chrome-nickel steel for example. Such a seal encloses an angle of 720°. It is therefore not only able to withstand high temperatures of up to 750° C. without damage but also provides for improved sealing of the expansion gap. Thus the turbine efficiency can again be increased and the service life of the nozzle ring can also be increased.

As an alternative to this, the seal is designed as a piston ring likewise made of a sufficiently heat-resisting material. This provides a further means of sealing the expansion gap, which means is available in accordance with the actual conditions of use.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of a turbocharger radial turbine provided with a nozzle ring, wherein.

Figure 1:
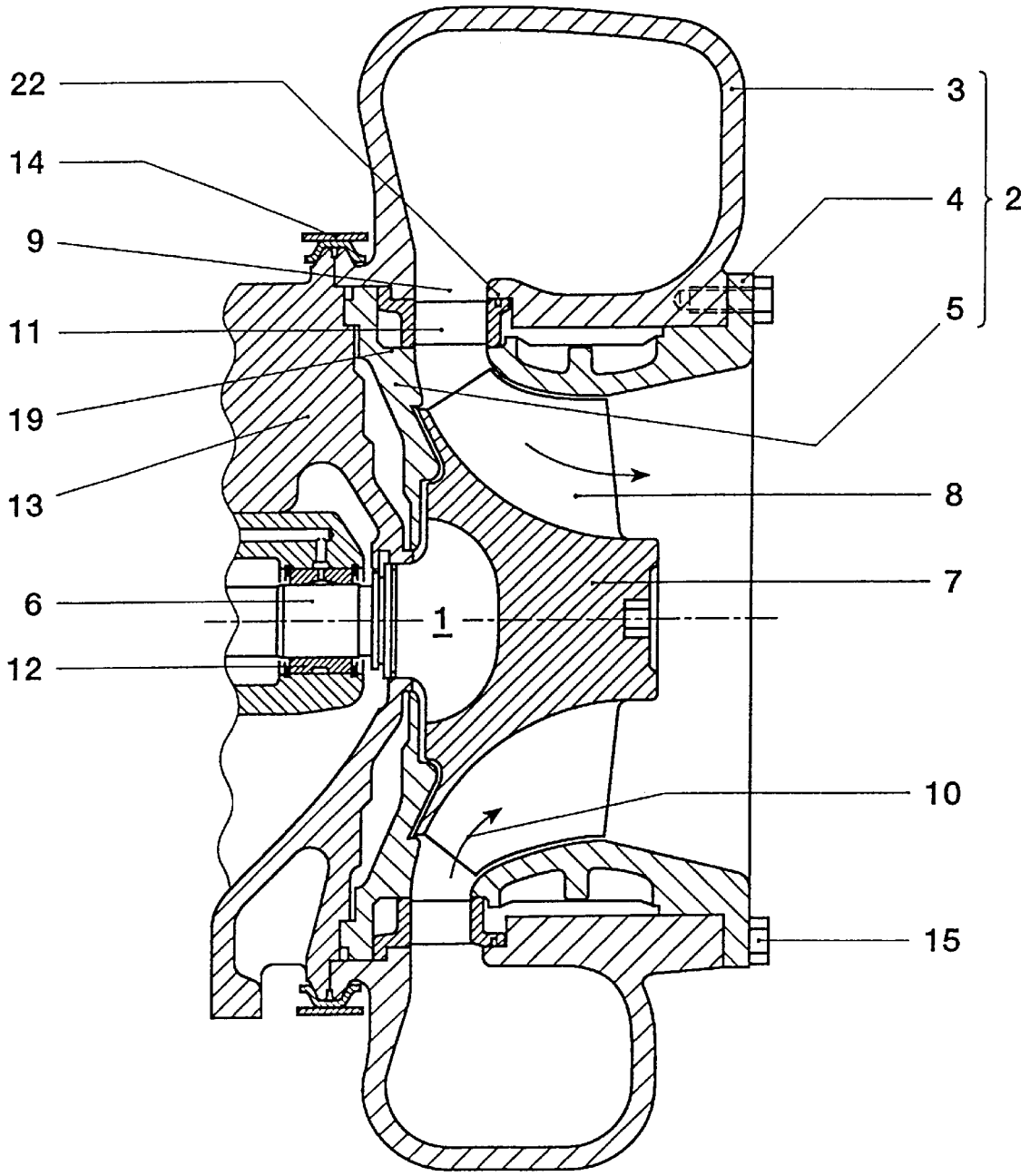
FIG. 1 shows a partial longitudinal section of the radial turbine.

Only the elements essential for understanding the invention are shown. Elements of the system which are not shown are, for example, the compressor side of the exhaust-gas turbocharger and the internal combustion engine connected to the radial turbine. The direction of flow of the working medium is indicated by arrows.

DESCRIPTION OF THE PREFERRED EMBODIMENTS

Referring now to the drawings, wherein like reference numerals designate identical or corresponding parts throughout the several views, the exhaust-gas turbocharger primarily comprises a compressor (not shown) and an exhaust-gas turbine 1 designed as a radial turbine. The radial turbine 1 has a turbine casing 2, having a spiral gas-inlet casing 3, a gas-outlet casing 4 designed as a gas-outlet flange, and a turbine-side casing component 5 designed as an intermediate wall. A turbine wheel 7 carried by a shaft 6 and having moving blades 8 is rotatably mounted in the turbine casing 2. On the compressor side, a compressor wheel (likewise not shown) is arranged on the shaft 6.

The gas-inlet casing 3 merges downstream into an inflow passage 9 for the exhaust gases 10 of an internal combustion engine (likewise not shown) connected to the exhaust-gas turbocharger. In the inflow passage 9, a nozzle ring 11 is arranged in a positive-locking manner between the gas-inlet casing 3 and both the gas-outlet flange 4 and the intermediate wall 5. The shaft 6 is rotatably mounted in a bearing housing 13 by means of bearings 12. The gas-inlet casing 3 and the bearing housing 13 are connected to one another via a tightening strap 14 arranged in the peripheral direction. The gas-outlet flange 4 and the gas-inlet casing 3 are releasably fastened to one another by screws 15 (FIG. 1).

Figure 2:
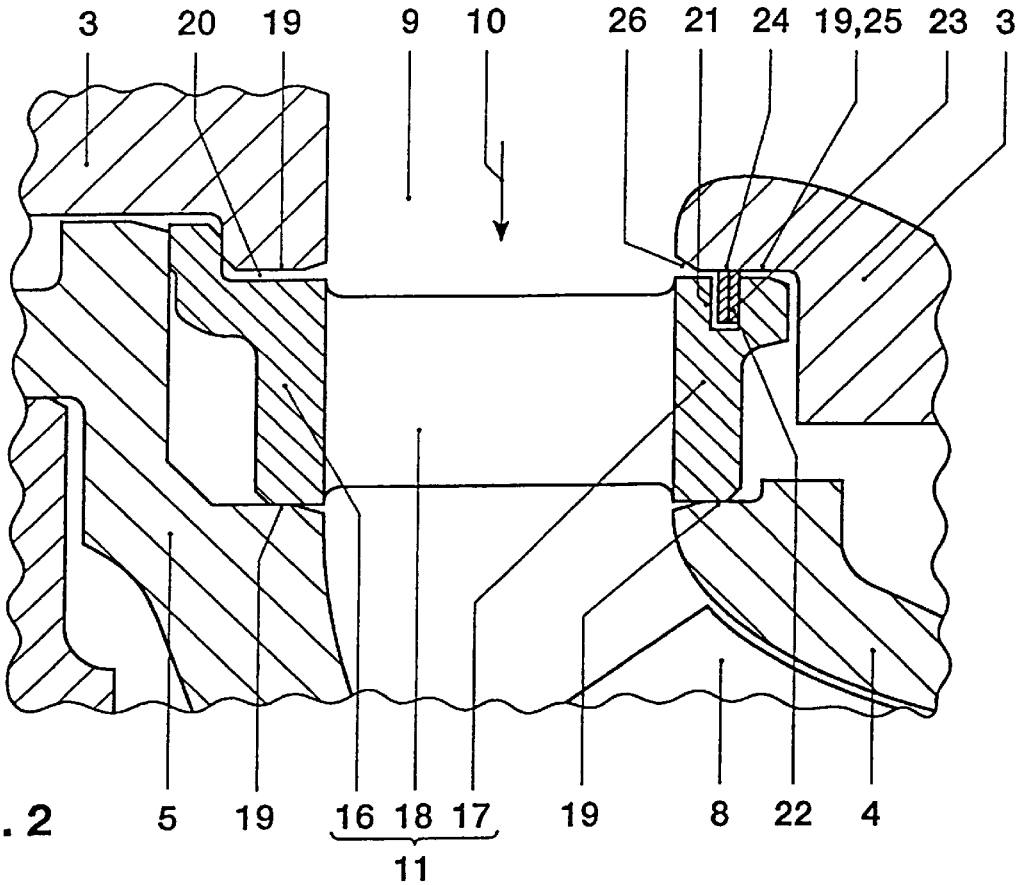
FIG. 2 shows an enlarged detail of FIG. 1 in the region of the nozzle ring.

The nozzle ring 11 consists of two annular fastening elements 16, 17 which are connected to one another via a number of guide blades 18. To accommodate the nozzle ring 11, the turbine casing 2 has a recess 19 in the region of the transition from the gas-inlet casing 3 to the gas-outlet flange 4 and the intermediate wall 5 respectively. An radial expansion gap 20 is formed in this recess 19, i.e. between the nozzle ring 11 and the turbine casing 2, which expansion gap 20 permits both the axial and radial expansion of the nozzle ring 11. On the gas-inlet side of the nozzle ring 11, an encircling groove 21 is arranged in the fastening element 17 and oriented in the direction of flow of the exhaust gases 10. The groove 21 accommodates a seal 22 designed as a double lamellar ring, i.e. enclosing an angle of 720°. The double lamellar ring 22 is made of chrome-nickel steel, although other heat-resisting materials may of course also be used. A sealing surface 23, 24 for the double lamellar ring 22 is in each case arranged both in the groove 21 and in the recess 19 of the turbine casing 2 (FIG. 2). Depending on the sealing requirement and the space conditions, a single or a triple lamellar ring may of course also be used.

Figure 3:
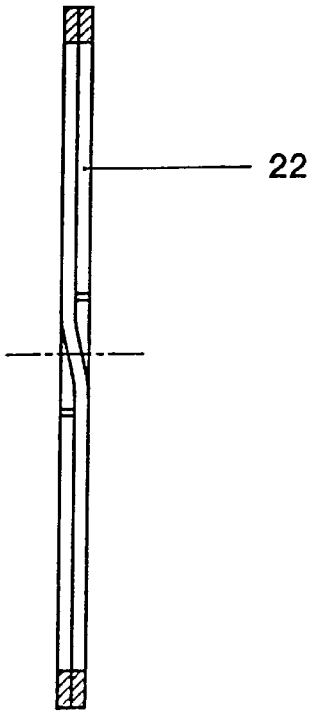
FIG. 3 shows a longitudinal section through the seal according to the invention corresponding to FIG. 1 but in an enlarged representation.

FIG. 3 shows a longitudinal section through the double lamellar ring 22 indicated and in addition partly shown in FIG. 1. For the sake of clarity, an enlarged representation has been selected for this purpose.

For fitting the double lamellar ring 22 is pushed together with the nozzle ring 11 onto a slightly smaller outside diameter 25 of the recess 19. This results in prestressing of the double lamellar ring 22, as a result of which the latter always bears against the sealing surface 24. In order facilitate the mounting of the double lamellar ring 22, the recess 19 in the region of the gas-inlet casing 3 is provided with a bevel 26.

During the operation of the internal combustion engine connected to the exhaust-gas turbocharger and designed as a diesel engine, its exhaust gases 10 pass first of all into the spiral gas-inlet casing 3 of the radial turbine 1. They are accelerated in the gas-inlet casing 3 and are directed with an optimum flow angle via the nozzle ring 11 to the turbine wheel 7. There the exhaust gases 10 are finally expanded. In the process, they deliver an output which serves to drive the shaft 6 and thus the compressor wheel.

On account of the design of the radial expansion gap 20, the nozzle ring 11 can freely expand in both the axial and radial direction. In the process, the exhaust-gas pressure acting via the inflow passage 9 and the expansion gap 20 always presses the double lamellar ring 22 against the sealing surface 23 of the groove 21. Consequently, the expansion gap 20 is largely sealed. Corresponding bench tests were able to establish gains in efficiency of up to three points compared with variants without sealing of the expansion gap 20.

Figure 4:
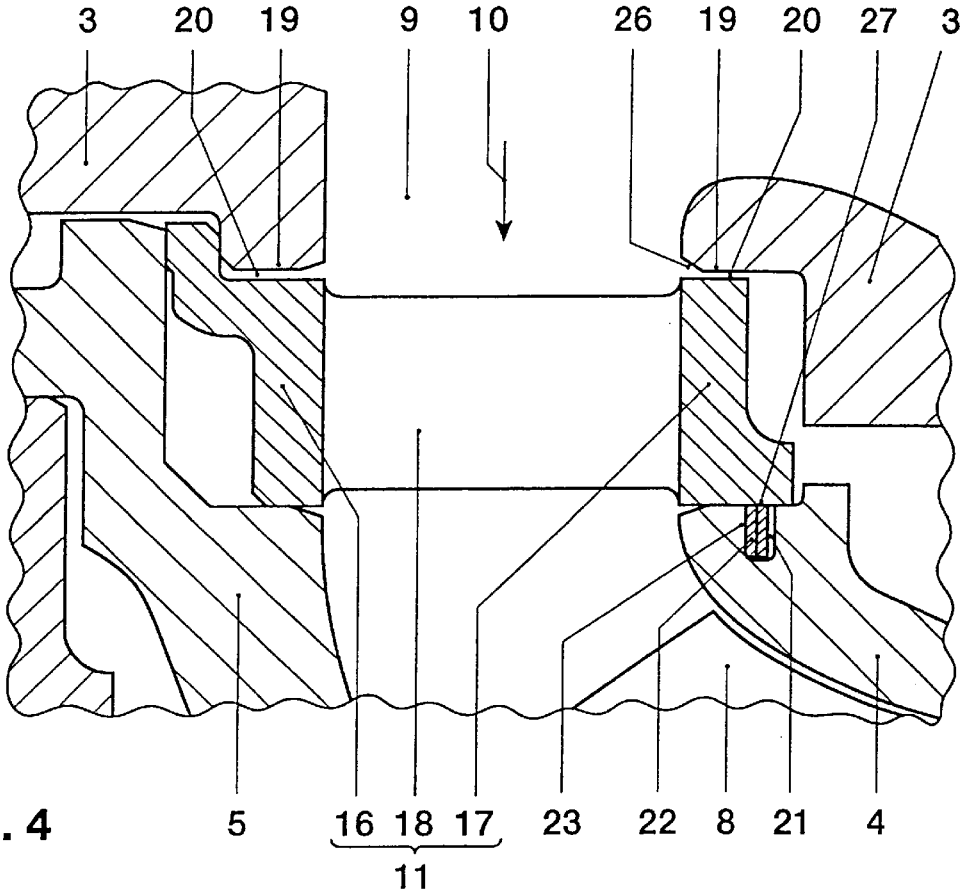
FIG. 4 shows a representation corresponding to FIG. 2 but in a second exemplary embodiment.

In a second exemplary embodiment of the invention, the encircling groove 21 is formed in the gas-outlet flange 4 (FIG. 4). Thus a second variant of the arrangement of the seal 22 is provided which is used in the case of appropriate constructional preconditions. Unlike the first exemplary embodiment, a second sealing surface 27 is formed on the fastening element 17 of the nozzle ring 11 in addition to the sealing surface 23 arranged in the groove 21. The function of this double lamellar ring 22 is analogous to the first exemplary embodiment. Of course, the encircling groove 21 may also be formed in the fastening element 16 or in the intermediate wall 5, i.e. likewise on the gas-inlet side or gas-outlet side of the nozzle ring 11 (not shown).

Figure 5:
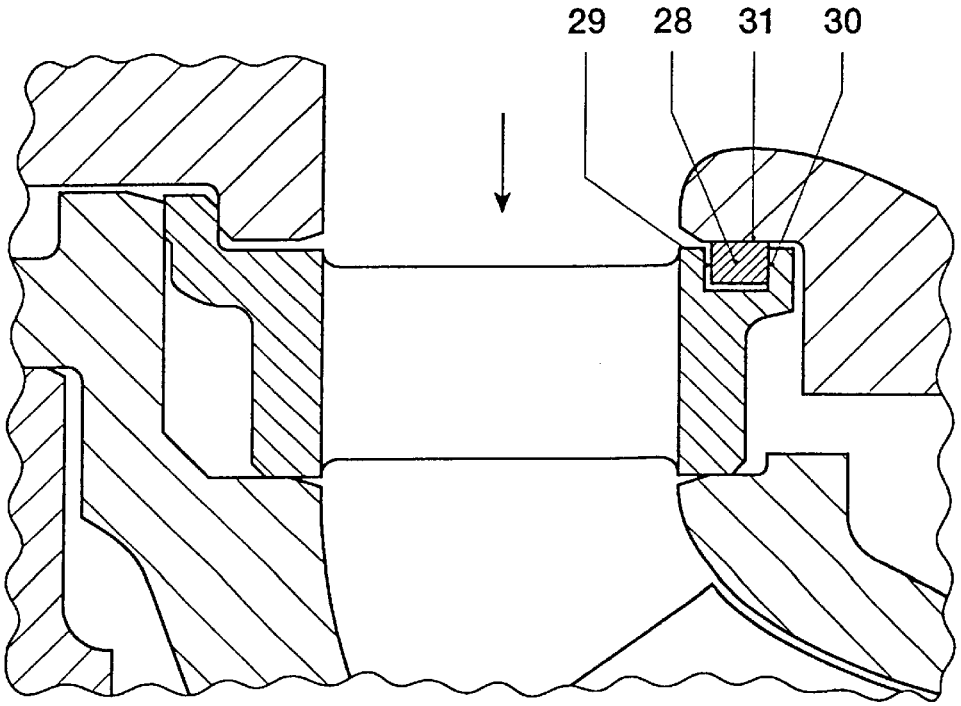
FIG. 5 shows a representation corresponding to FIG. 2 but in a third exemplary embodiment.

According to FIG. 5, in a third exemplary embodiment, a seal 28 designed as a piston ring is arranged on the gas-inlet side of the nozzle ring 11 between fastening element 17 of the latter and the gas-inlet casing 3. The piston ring 28 is accommodated by an appropriately adapted groove 29. A sealing surface 30, 31 for the piston ring 28 is arranged in each case, in both the groove 29 and the recess 19 of the turbine casing 2. In order to ensure sound sealing, a piston ring 28 having a locked joint is used (not shown). All further components of the radial turbine 1 are of analogous design to the first exemplary embodiment. The function of the piston ring 28 corresponds to the function of the double lamellar ring 22.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. An exhaust-gas turbine of a turbocharger comprising:

a turbine casing having a gas-inlet casing a gas-outlet casing and at least one turbine-side casing component;

a turbine wheel rotatably mounted on a shaft and having moving blades an inflow passage formed in the turbine casing upstream of the turbine wheel for the exhaust gases of an internal combustion engine connected to the turbocharger; and a nozzle ring arranged in the inflow passage, fastened in a recess of the turbine casing and directing the exhaust gases onto the moving blades, a radial expansion gap is formed between the turbine casing and the nozzle ring, and at least one seal is arranged in the expansion gap, wherein the nozzle ring includes two fastening elements which are arranged in the recess and are connected to one another via a number of guide blades, and an encircling groove accommodating the seal is formed either in at least one of the fastening elements or in at least one of the components of the turbine casing which surround the fastening elements.

2. The exhaust-gas turbine as claimed in claim 1, wherein the encircling groove is oriented in the direction of flow of the exhaust gases.

3. The exhaust-gas turbine as claimed in claim 2, wherein the seal is arranged between the gas-inlet casing and the nozzle ring.

4. The exhaust-gas turbine as claimed in claim 2, wherein the seal is arranged between the turbine-side casing component and the nozzle ring.

5. The exhaust-gas turbine as claimed in claim 2, wherein the seal is arranged between the gas-outlet casing and the nozzle ring.

6. The exhaust-gas turbine as claimed in claim 3, wherein the seal is designed as a lamellar ring, in particular as a double lamellar ring.

7. The exhaust-gas turbine as claimed in claim 6, wherein the lamellar ring is made of a sufficiently heat-resisting material, in particular chrome-nickel steel.

8. The exhaust-gas turbine as claimed in claim 3, wherein the seal is designed as a piston ring.

9. The exhaust-gas turbine as claimed in claim 8, wherein the piston ring is made of a sufficiently heat-resisting material, in particular chrome-nickel steel.

* * * * *